US007682209B2

(12) United States Patent
Huang

(10) Patent No.: US 7,682,209 B2
(45) Date of Patent: Mar. 23, 2010

(54) SAFETY STRUCTURE FOR DISASSEMBLING AND POSITIONING AN AIRBAG

(75) Inventor: Ray Huang, Taipei County (TW)

(73) Assignee: Ever-Quick Co., Ltd., Taipei County (TW)

( * ) Notice: Subject to any disclaimer, the term of this patent is extended or adjusted under 35 U.S.C. 154(b) by 105 days.

(21) Appl. No.: 12/145,500

(22) Filed: Jun. 24, 2008

(65) Prior Publication Data

US 2009/0318042 A1 Dec. 24, 2009

(51) Int. Cl.
*B63C 9/15* (2006.01)

(52) U.S. Cl. ..... 441/93

(58) Field of Classification Search ..... 441/92–94, 441/96

See application file for complete search history.

(56) References Cited

U.S. PATENT DOCUMENTS 4,608,926 A * 9/1986 Stevens ..... 102/275.4
4,619,285 A * 10/1986 Piet ..... 137/68.13
5,374,212 A * 12/1994 Lall ..... 441/96
5,921,832 A * 7/1999 Thiermann ..... 441/41
6,805,599 B1 * 10/2004 Huang ..... 441/88
6,951,493 B1 * 10/2005 Lu ..... 441/93
7,299,816 B2 * 11/2007 Rouleau et al. ..... 137/68.3
7,328,464 B2 * 2/2008 Lee ..... 2/456
2007/0193625 A1 * 8/2007 Mackal ..... 137/68.3

* cited by examiner

*Primary Examiner*—Stephen Avila
(74) *Attorney, Agent, or Firm*—Banger Shia

(57) ABSTRACT

A safety structure for disassembling and positioning an airbag device comprises an actuating device having an air bottle and pivotally connected to a positioning member. A quick male and female connection means is provided between the airbag device and the corresponding structure, and a safety device is used to engage and disengage with the quick male and female connection means. A check device is disposed at an air tap of the airbag device, such that the airbag device keeps in the inflation state after being disassembled. The positioning member is disposed with an engaging member corresponding to the engaging structure of the actuating device to adjust the tightness between the positioning member and the actuating device. A retaining device comprises a vent rod and an airtight stopper, which allows the airbag device to deflate or inflate, such that the airbag device can be used repeatedly.

14 Claims, 7 Drawing Sheets

SAFETY STRUCTURE FOR DISASSEMBLING AND POSITIONING AN AIRBAG

BACKGROUND OF THE INVENTION

1. Field of the Invention

The present invention relates to a safety structure for disassembling and positioning an airbag device which controls the disassembly and connection of an airbag device after the airbag device is inflated, and makes the airbag device multifunctional by cooperating with a check structure disposed in an air tap of the airbag device, a quick male and female connection means, a safety device disposed at one side of the quick male and female connection means and a retaining device, and achieves the object of high convenience and safety since the tightness of actuating structure of the airbag device can be adjusted effectively by an adjustable engaging member.

2. Description of the Prior Art

For the method of storage of airbag device, the airbag device of the most of the conventional life jackets or other lifesaving equipments is usually folded in an airtight space which can cooperate with relative structure to inflate the airbag device.

However, the above-mentioned conventional structure still has the following disadvantages:

Firstly, low applicability: since the airbag device is usually positioned on the life jacket or the corresponding structure and cannot be used separately, its applicability is low. For example, the airbag device positioned on the life jacket cannot be disassembled and used on other lifesaving equipments, or used as a playing equipment.

Secondly, the tightness of actuating structure of the airbag device cannot be adjusted effectively: when actuating the airbag device, the structure for actuating the airbag device can not adjust the tightness of the airbag device effectively to better satisfy the demands of different users with different hand strengths or habits. As a result, the user with weak hand strength is unable to actuate inflation operation for inflating the airbag device effectively and quickly.

Thirdly, low performance of unfolding the airbag device: since the structure for containing the airbag device is airtight, it should take a relatively long time to fully inflate the airbag device, wasting the lifesaving opportunity.

Fourthly, the fastening device is unadjustable, the fastening device for fastening to the user's body fixed in length and unchangeable, thus it lacks flexibility.

The present invention has arisen to mitigate and/or obviate the afore-described disadvantages.

SUMMARY OF THE INVENTION

The present invention is to provide a safety structure for disassembling and positioning an airbag device which allows an airbag device to disassemble from and connect to the user according to different requirements, and has high safety since the tightness of actuating structure of the airbag device can be adjusted to a suitable range.

The primary objective of the present invention is to provide a safety structure for disassembling and positioning an airbag device which allows an airbag device to combine with and disassemble from the corresponding structure effectively, wherein a quick male and female connection means is provided between the airbag device and the corresponding structure, and a check device is disposed at an air tap of the airbag device, such that the airbag device keeps in the inflation state after being disassembled. Moreover, a safety device is disposed at one side of the quick male and female connection means, and the airbag device can only be disassembled by releasing the safety device, so as to achieve the object of quick disassembling and high safety.

The second objective of the present invention is to provide a safety structure for disassembling and positioning an airbag device which comprises a retaining device having an airtight stopper and a vent rod. The airtight stopper is in the form of a nut and is defined with outer threads to be screwed with inner threads of an air tap, so as to seal the air tap to prevent air from leaking therefrom. One end of the vent rod is a small diameter top portion, and the other end of the vent rod is a large diameter end and is defined with outer threads to be screwed with the inner threads of the air tap for enabling the check device disposed at the air tap to away from its sealing position. In a center of the vent rod is defined a vent hole for deflating or inflating the airbag device, which allows the retaining device to inflate or deflate the airbag device.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
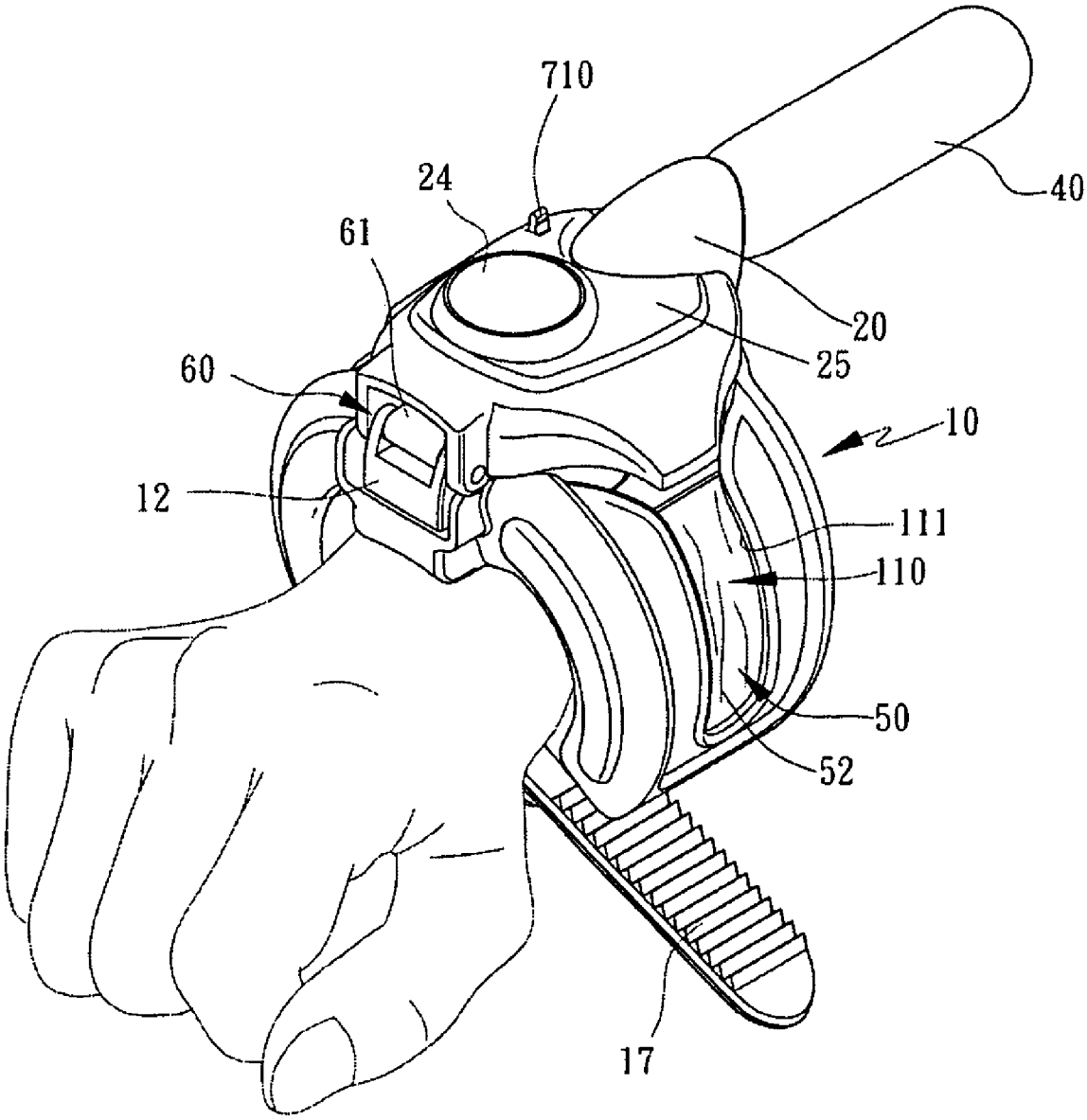
FIG. 1 is a perspective view of a safety structure for disassembling and positioning an airbag device in accordance with the present invention.
Figure 2:
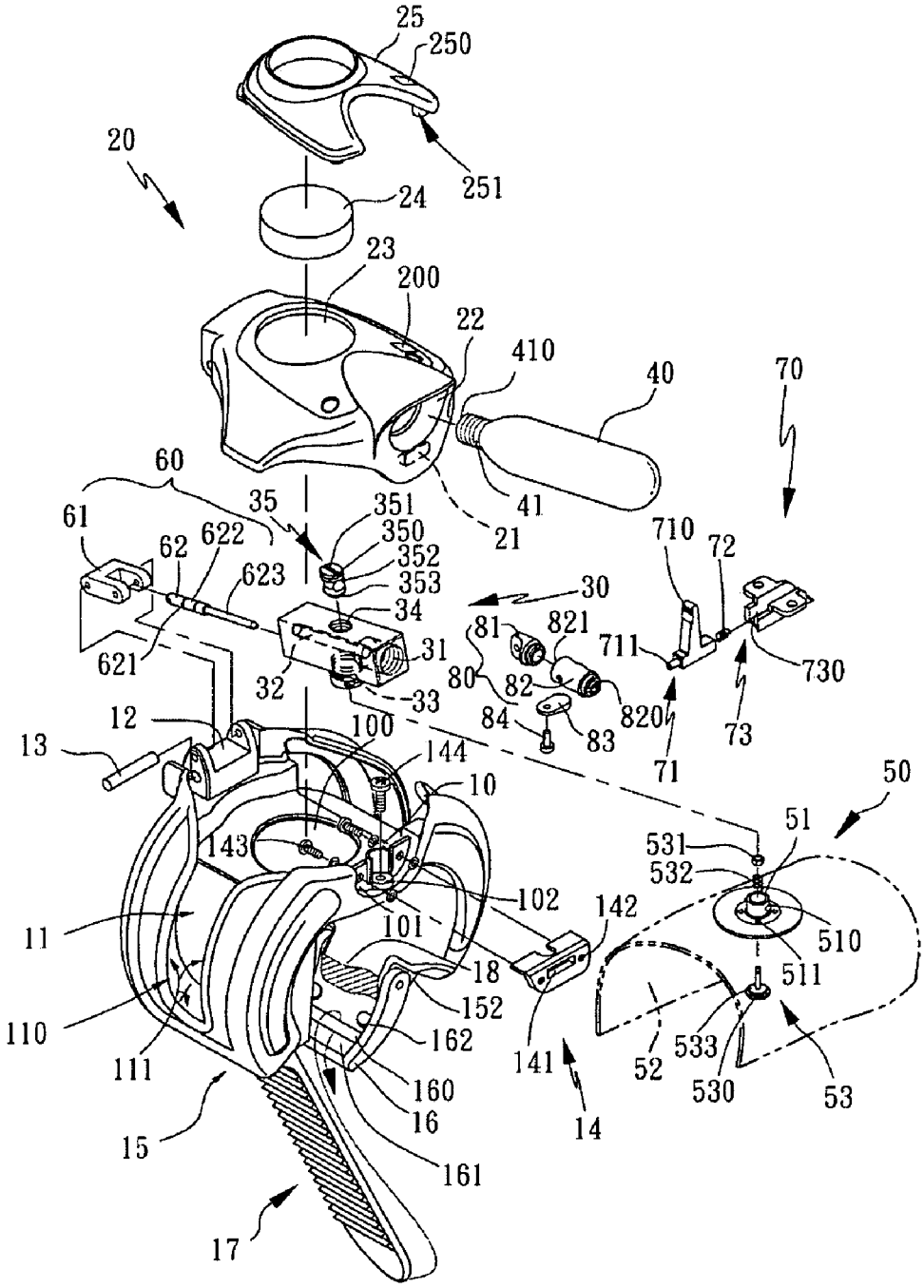
FIG. 2 is an exploded view of the safety structure for disassembling and positioning an airbag device in accordance with the present invention.
Figure 3:
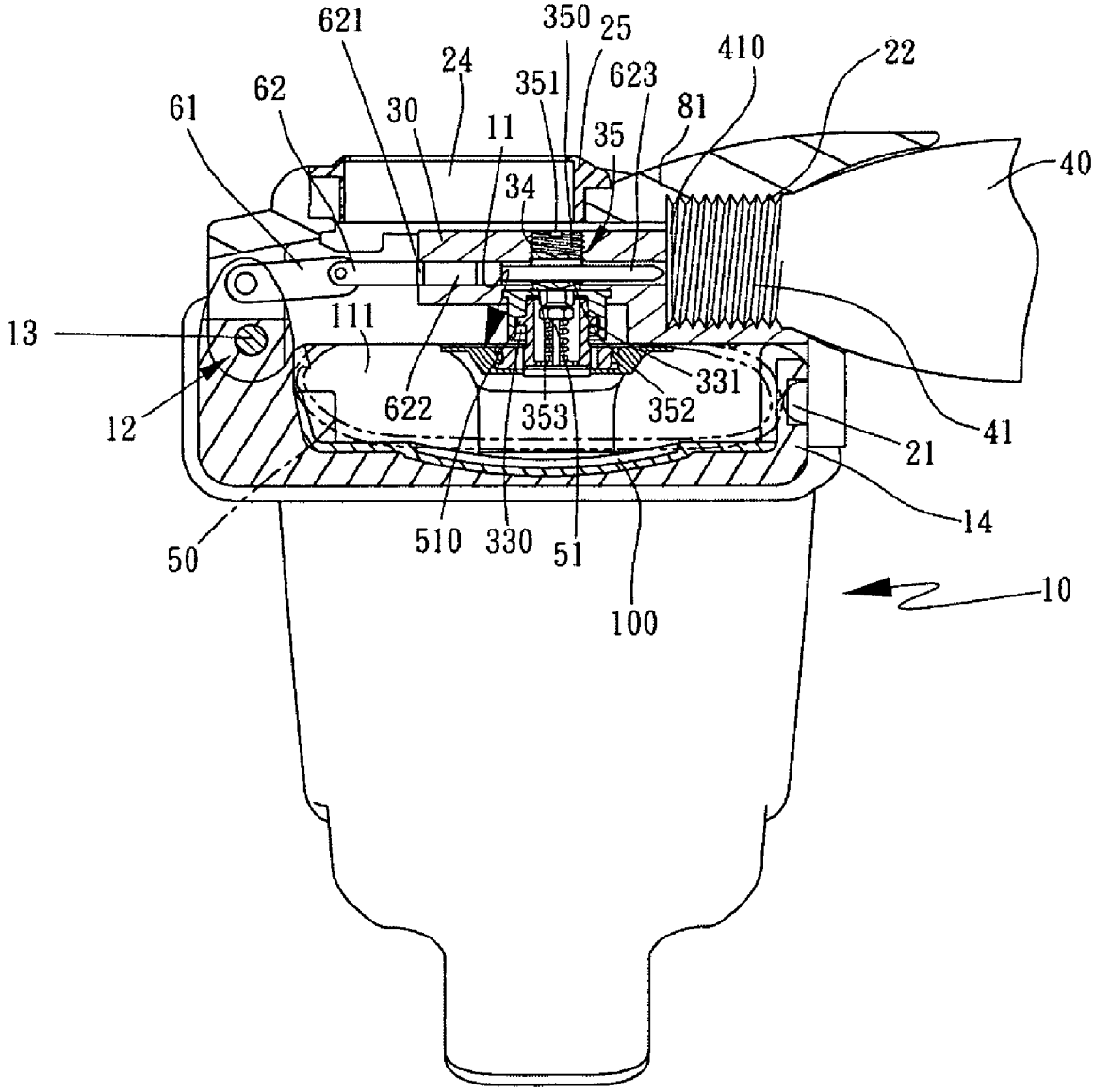
FIG. 3 is a cross sectional view of the safety structure for disassembling and positioning an airbag device in accordance with the present invention.

Referring to FIGS. 1-3, a safety structure for disassembling and positioning an airbag device in accordance with the present invention comprises a U-shaped positioning member 10. Both ends of the positioning member 10 are formed with a containing portion 11, respectively. The containing portion 11 is defined with an open portion 110 in the center thereof, and around the inner periphery of the containing portion 11 is formed an elastic receiving portion 111. One side of the positioning member 10 is provided with a pivotal portion 12 which is pivotally connected to one end of an actuating device 20 by a pivot shaft 13, and the other side of the positioning member 10 is provided with an engaging member 14 which is elastically engaged with the other end of the actuating device 20. An end of each of the containing portions 11 is provided with a connecting portion 15, one of the connecting potions 15 is pivotally connected to a frame-shaped fastener 16 via a pivot shaft, and a strip-shaped combining strip 17 is extended from the other connecting portion 15. The combining strip 17 inserts into and winds around the fastener 16 to position on user's wrist. At the position of the fastener 16 adjacent to the user's hands is provided a flexible and laminar pad 18.

At the waist portion of the fastener 16 is provided a separating rod 160 which divides the fastener 16 into two hollow guiding portions 161. A free end of the 17 inserts into the guiding portions 161, then winds around the separating rod 160, and finally moves back. Both sides of the fastener 16 are provided with a round protrusion 162 with which the combining strip 17 is to be engaged.

Figure 4:
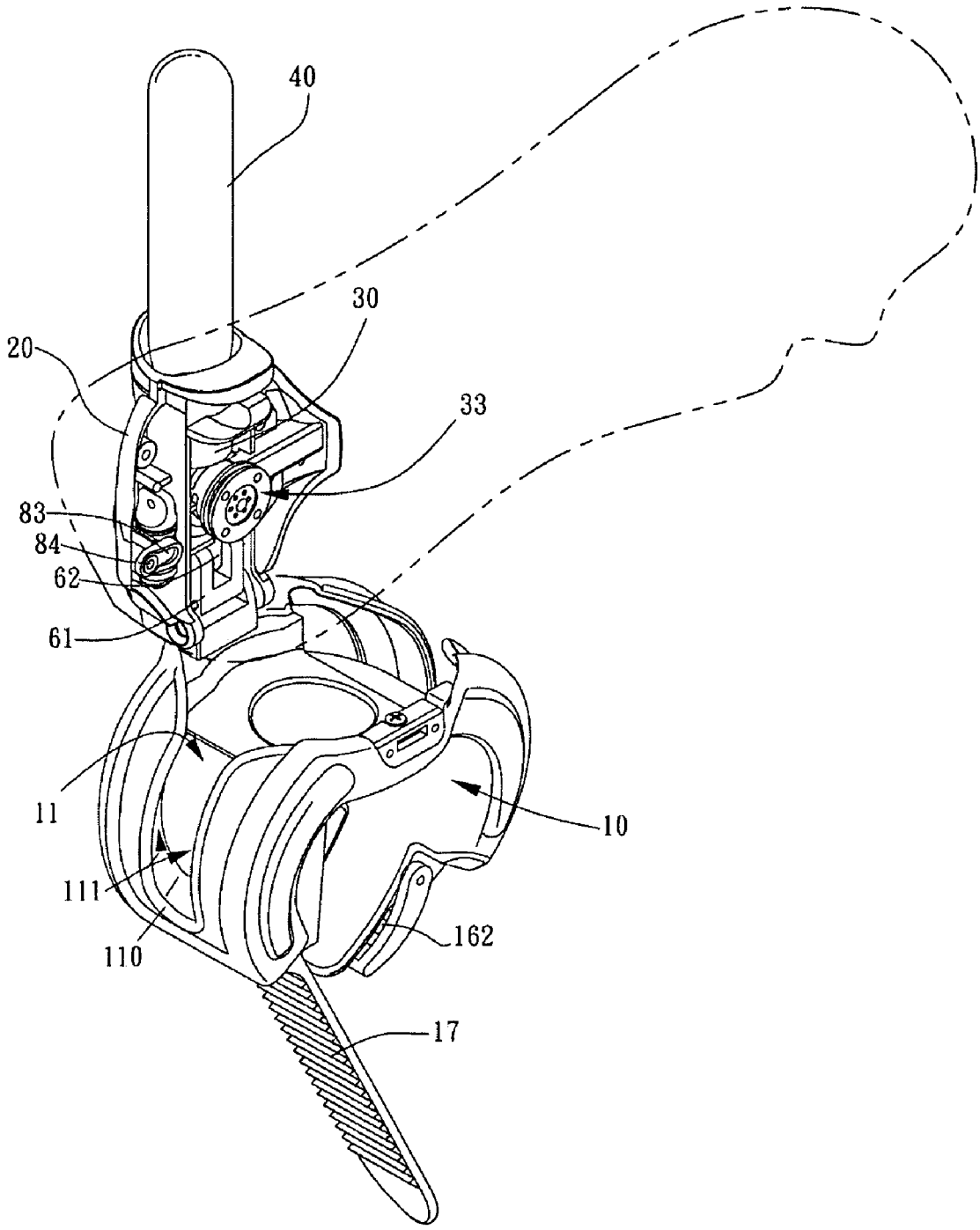
FIG. 4 is a perspective view of the safety structure for disassembling and positioning an airbag device in accordance with the present invention.

Referring to FIGS. 2-4, in a center of the actuating device 20 is provided a mounting member 30 for mounting an air bottle 40 and an airbag device 50. The airbag device 50 is folded and received in the receiving portions 111 of the containing portions 11. When the user pulls the actuating device 20, the airbag 52 of the airbag device 50 will be inflated out of the open portions 110 from the periphery which was previously pressed under the receiving portions 111, so as to achieve the object of quick inflation.

An end of the air bottle 40 is exposed out of the other end of the actuating device 20 for the user to pull it. An actuator 60 is provided between the actuating device 20 and the positioning member 10 and located corresponding to the air bottle 40 for puncturing a sealing member 410 of the air bottle 40 when the actuating device 20 is actuated. This part is the feature of a previous invention of the inventor, so it will not be described in detail. The feature of the prevent invention is that both sides of the mounting member 30 are provided with a safety device 70 and a retaining device 80 to lock and open the airbag device 50 mounted on the mounting member 30. Moreover, with a check structure disposed on the airbag device 50, the present invention is safer and multi-purpose. The retaining device 80 can be disassembled from or assembled back to the mounting member 30 to deflate or inflate the airbag device 50, or to protect an air tap 51, so as to achieve the object of high safety and diversification.

The positioning member 10 is provided with the vertical and laminar engaging member 14 corresponding to the other end of the actuating device 20, and the actuating device 20 is provided with an elastic portion 21 which is elastically engaged with the engaging member 14. The positioning member 10 is defined with a hollow portion 100 in a bottom thereof and is formed with two vertical pin-insertion portions 101 located corresponding to the engaging member 14, each pin-insertion portion 101 is defined with a through hole. In a center between the pin-insertion portions 101 is provided an adjusting seat 102 having a threaded hole. The engaging member 14 is a reverse L-shaped plate, a vertical side of the engaging member 14 is located outside the pin-insertion portions 101 and is formed with a concave engaging portion 141 to be engaged with the elastic portion 21 of the actuating device 20. Both ends of the vertical side of the engaging member 14 are defined with a threaded portion 142 in the form of a threaded hole. Two positioning bolts 143 are screwed through the pin-insertion portions 101 into the threaded portions 142, such that the engaging portion 141 is caused to abut against the pin-insertion portions 101. A forcing bolt 144 in the form of a screw bolt passes through a center of a horizontal side of the engaging member 14. A threaded end of the forcing bolt 144 is screwed in the adjusting seat 102, and a large diameter head portion of the forcing bolt 144 pushes against the engaging member 14, such that the engaging member 14 can be adjusted to close to or away from the elastic portion 21 of the actuating device 20, and the engaging tightness between the engaging member 14 and the actuating device 20 can be effectively controlled.

The actuating device 20 is a hollow cover which cooperates with the air bottle 40 and the positioning member 10, and the air bottle 40 is inserted into the mounting member 30 disposed in the actuating device 20. In addition to the elastic portion 21, the actuating device 20 is further defined with an inserting portion 22 in the form of an opening in which the air bottle 40 is inserted. In a center of an outer surface of the actuating device 20 is defined a groove 23 in which a member 24 is placed, and a cover 25 covers the groove 23. The actuating device 20 is defined with a through hole 200, the cover 25 is defined with a penetrating hole 250 aligned with the through hole 200, and the through hole 200 and the penetrating hole 250 are provided for insertion of the safety device 70. The cover 25 is provided with an elastic leg 251 to be engaged in the actuating device 20. The member 24 can be a decoration, such as an electronic watch or a compass or a figurative mark.

The mounting member 30 is defined with a combining portion 31 in the form of an opening corresponding to the air bottle 40, and a combining portion 41 of the air bottle 40 which has outer threads is screwed with the combining portion 31. At the end of the air bottle 40 is provided the sealing member 410. The mounting member 30 is defined with a guiding portion 32 connected to the combining portion 31. A tap-receiving portion 33 having an inner guiding structure is defined in the mounting member 30 and is vertical and connected to the guiding portion 32 for quick connection and disconnection of one end of the air tap 51 of the airbag device 50. The airbag 52 is disposed at the other end of the air tap 51 of the airbag device 50. The actuator 60 is movably received in the guiding portion 32.

The actuator 60 comprises an actuating member 61 and a guide shaft 62. One end of the actuating member 61 is pivotally connected to the pivotal portion 12 of the positioning member 10, and the pivotal position of the actuating member 61 with respect to the positioning member 10 is different from that of the actuating device 20. The other end of the actuating member 61 is pivotally connected to one end of the guide shaft 62, and the other end of the guide shaft 62 is inserted into the guiding portion 32 of the mounting member 30. The guide shaft 62 is provided with a plurality of sets of airtight portions 621 in the form of an airtight ring, and the other end of the guide shaft 62 is formed with a firing pin 623 having a sharp end. When the user pulls the actuating device 20, the actuating member 61 will push the guide shaft 62 to puncture the sealing member 410 of the air bottle 40 with the firing pin 623, thus achieving the effect of quick inflation (as shown in FIG. 4).

Figure 5:
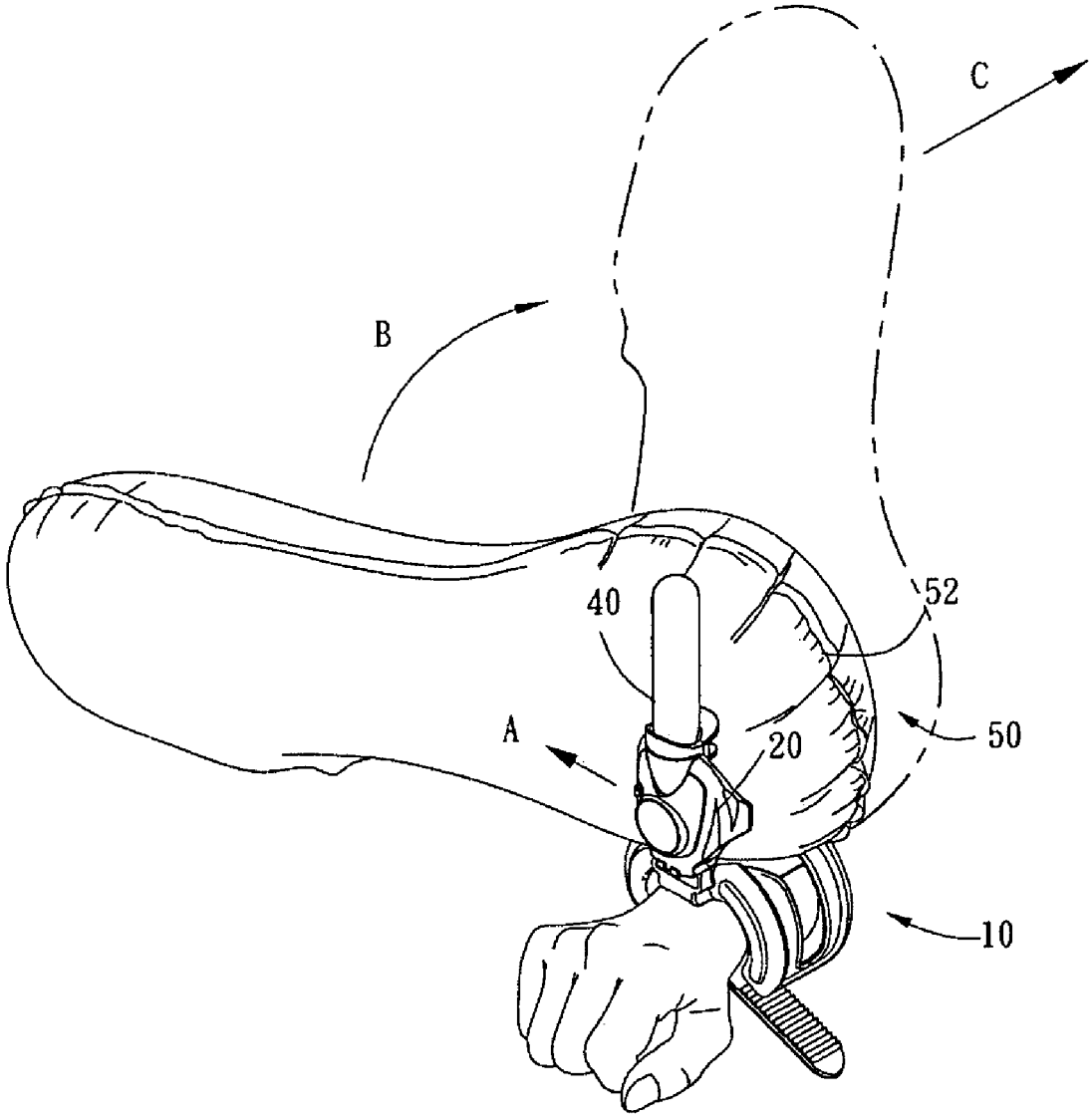
FIG. 5 is an illustrative view showing the disassembly of an airbag device.
Figure 6:
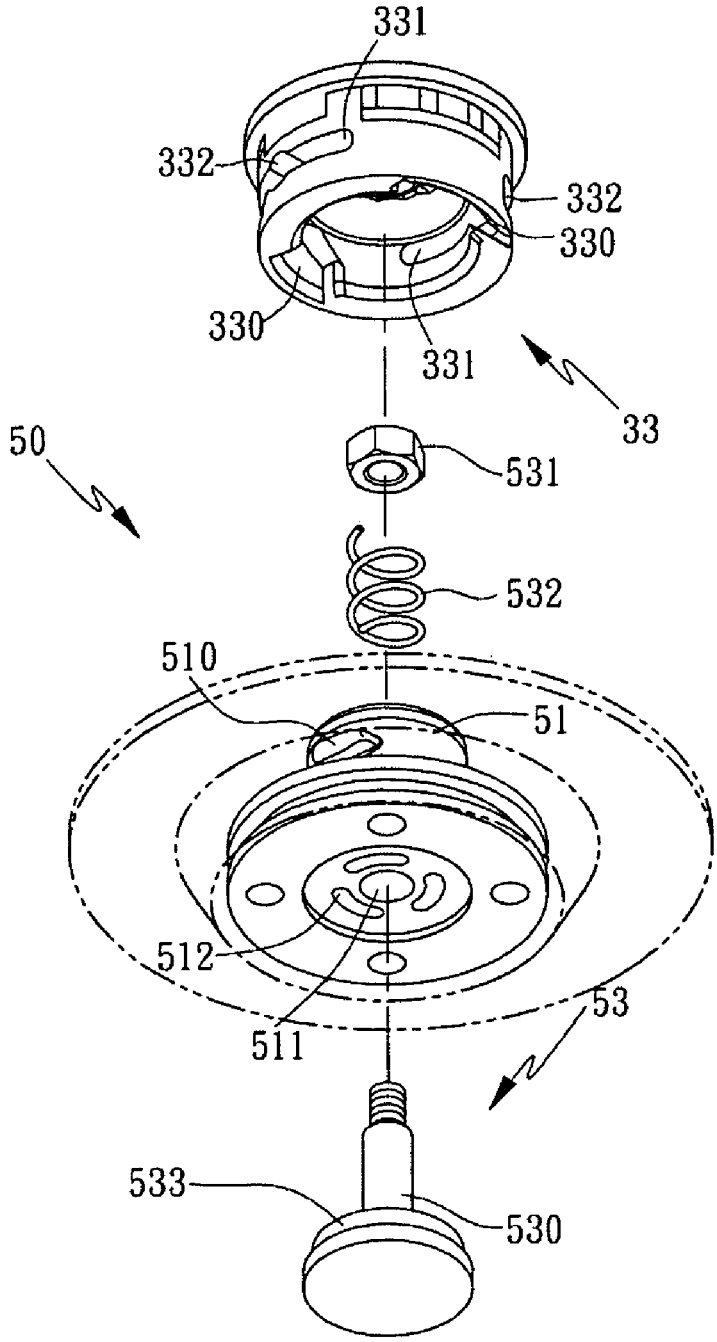
FIG. 6 is an illustrative view showing an air tap being disassembled from and combined with a tap-receiving portion.

Referring to FIGS. 5 and 6, the tap-receiving portion 33 is disposed in a center of the guiding portion 32 of the mounting member 30 and located toward the airbag device 50. In an inner surface of the tap-receiving portion 33 are defined more than two sets of guiding recesses 330, and the guiding recesses 330 can be designed to be different from one another in width. Each guiding recess 330 extends slantingly to connect a horizontal guiding slot 331 which is defined in the inner surface of the tap-receiving portion 33 and penetrates the peripheral surface of the tap-receiving portion 33. A penetrating locking hole 332 with a circular cross section is defined in the guiding slot 331 and located adjacent to the guiding recess 330. On an outer surface of the air tap 51 of the airbag device 50 is horizontally provided a plurality of guiding blocks 510 which can be designed to be different from one another in width, and the thickness of one end of each guiding block 510 are smaller than the other end. When the guiding blocks 510 are aligned with the guiding recesses 330, they can enter the guiding slots 331, and then the airbag device 50 is rotated a certain angle to move the guiding blocks 510 over the locking holes 332. The safety device 70 is disposed outside the tap-receiving portion 33 and is to be inserted in the locking holes 332 to stop the large and thicker end of the guiding blocks 510 for prevention of reverse movement of the guiding blocks 510, thus achieving the effect of tightly positioning the airbag device 50. The guiding blocks 510 are shaped and sized to fit the guiding recesses 330, such that the airbag device 50 can be assembled precisely and maintained in a certain assembling direction.

In an inner surface of the air tap 51 of the airbag device 50 is defined inner threads to be screwed with the corresponding components of the safety device 70. In a bottom of the air tap 51 is defined a through hole 511 for insertion of a check device 53 as shown in FIG. 6. Around the periphery of the through hole 511 is defined a plurality of air holes 512. The check device 53 comprises a main member 530 in the form of a screw bolt. One end of the main member 530 is a large diameter disk, and the other end of the main member 530 is a shaft which has inner threads and passes through the through hole 511. An end of the shaft is screwed with a fixing member 531 in the form of a nut. An elastic member 532 in the form of a spring is mounted on the main member 530 and biased between the fixing member 531 and the through hole 511, so that the disk end of the main member 530 is forced to seal the air holes 512 under normal condition. When high pressure air is filled into the air bottle 40, it will push the main member 530 away from the air holes 512, so that the airbag device 50 can be inflated until the air bottle 40 is fully empty, after that, the main member 530 can return to its sealing position. In addition, in order to improve the airtight effect of the main member 530, the main member 530 is further provided with an annular stopping member 533.

One lateral side of the mounting member 30 is formed with an adjusting portion 34 which is in the form of a threaded hole and located opposite the tap-receiving portion 33 as shown in FIGS. 2 and 3. An adjusting member 35 which is in the form of a screw bolt having outer threads is disposed in the adjusting portion 34. One end of the adjusting member 35 protruded out of the adjusting portion 34 is provided with an adjusting end 350 having a driven portion 351 in the form of an elongated groove in which a screwdriver is to be inserted for screwing operation. In a middle portion of the adjusting member 35 is defined a penetrating portion 352 for insertion of the firing pin 623. The other end of the adjusting member 35 is provided with a tapered regulating portion 353 opposite the tap-receiving portion 33, such that when the adjusting member 35 rotates a small angle, the distance between the regulating portion 353 and the tap-receiving portion 33 can be adjusted, so as to control the inflation speed.

Figure 7:
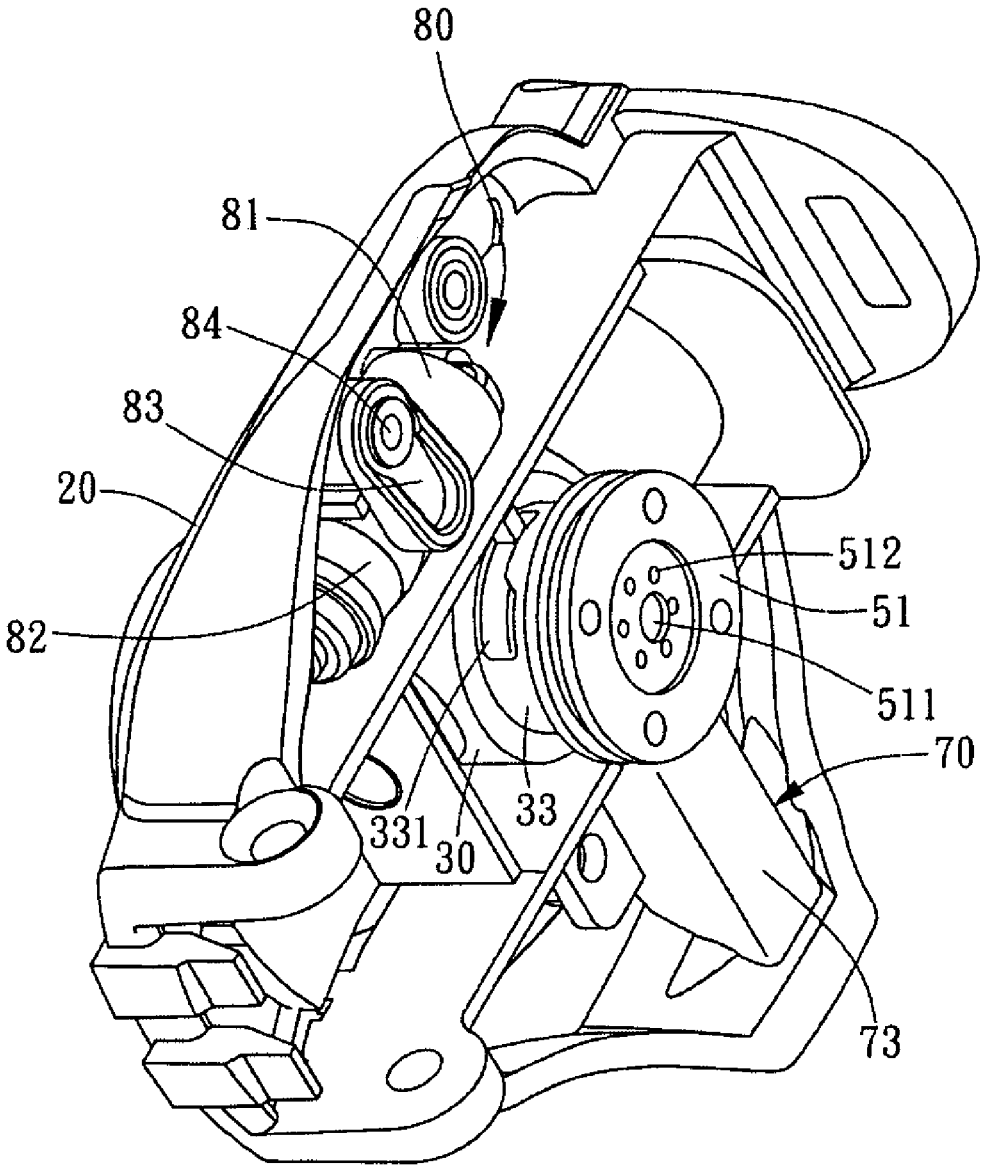
FIG. 7 is an amplified view of an actuating device.

The safety device 70 is provided with a safety bolt 71, and a pushing portion 710 which can be pushed by user's finger is vertically extended from the safety bolt 71 and passes through the through hole 200 and the penetrating hole 250 of the actuating device 20. A column-shaped locking portion 711 is extended from one horizontal end of the safety bolt 71 and is inserted into the locking holes 332, and the other horizontal end of the safety bolt 71 is provided with an elastic element 72 in the form of a spring to push the locking portion 711 into the locking holes 332 for prevention of reverse movement of the guiding blocks 510. The safety bolt 71 and the elastic element 72 are simultaneously put into a reverse T-shaped seat 73. The seat 73 is defined with a receiving groove 730 corresponding to the safety bolt 71, and both extended sides of the seat 73 are provided for insertion of bolts, so as to position the safety device 70 in the actuating device 20 as shown in FIG. 7.

The retaining device 80 comprises an airtight stopper 81 and a vent rod 82. The airtight stopper 81 is in the form of a nut and is defined with outer threads to be screwed with the inner threads of the air tap 51, so as to seal the air tap 51 to prevent air from leaking therefrom. One end of the vent rod 82 is a small diameter top portion 820, and the other end of the vent rod 82 is a large diameter end and is defined with outer threads to be screwed with the inner threads of the air tap 51 for enabling the top portion 820 to push the fixing member 531 to make the main member 530 move away from its sealing position. In a center of the vent rod 82 is defined a penetrating vent hole 821 for deflating the airbag device 50, and the vent rod 82 is defined with a notch adjacent to the top portion 820 for discharging air.

The top portion 820 of the vent rod 82 is defined with inner threads to be screwed with the outer threads of the airtight stopper 81. When the airtight stopper 81 and the vent rod 82 are screwed to each other, a laminar blocking member 83 cooperates with a fixing bolt 84 to lock the airtight stopper 81 and the vent rod 82 in a space of the actuating device 20 outside the mounting member 30, and a free end of the blocking member 83 is abutted against the airtight stopper 81 and the vent rod 82.

Therefore, the present invention has the following advantages:

Firstly, quick releasing and positioning: with the safety device 70, the airbag device 50 can be positioned on the mounting member 30 stably, so the present invention has high safety. The airbag device 50 can be disassembled by releasing the safety device 70 as shown in FIG. 5. The airtight stopper 81 of the retaining device 80 enables the airbag device 50 to be kept in the best inflation state to make the user float, so the present invention has high applicability and is multi-purpose.

Secondly, repetitive use and high convenience: with the vent rod 82 of the retaining device 80, the airbag device 50 can be deflated quickly and folded effectively, so as to achieve the object of repetitive use, quick deflation and high convenience.

Thirdly, easy storage and space saving: since the safety device 70 and the retaining device 80 are all disposed in the actuating device 20, the prevent invention is convenient to carry and space saving.

Fourthly, largely improve the lifesaving speed: since the containing portions 11 are semi-open structures, the airbag device 50 can be inflated quickly, and since the airbag device 50 can be unfolded quickly and completely, the lifesaving speed is largely improved.

Fifthly, convenient to fold: since the containing portions 11 are semi-open structures, the airbag device 50 is convenient to fold after being used.

While we have shown and described various embodiments in accordance with the present invention, it should be clear to those skilled in the art that further embodiments may be made without departing from the scope of the present invention.

What is claimed is:

1. A safety structure for disassembling and positioning an airbag device, comprising: a positioning member, one side of the positioning member being provided with a pivotal portion pivotally connected to one end of an actuating device, the other side of the positioning member being provided with an engaging member to be engaged with the other end of the actuating device;

in a center of the actuating device being provided a mounting member for mounting an air bottle and an airbag device, an actuator being disposed between the actuating device and the positioning member and located corresponding to the air bottle, the actuator being provided with a firing pin located corresponding to the air bottle, the air bottle being provided with a sealing member, the airbag device being provided with an air tap connected to the mounting member and the air bottle, a check device being inserted into the air tap;

the mounting member being provided with a tap-receiving portion located corresponding to the air tap, in the tap-receiving portion being defined more than two sets of guiding recesses, the air tap being provided with more than two sets of guiding blocks aligned with the guiding recesses of the tap-receiving portion, each guiding recess extending slantingly to connect a horizontal guiding slot penetrating a peripheral surface of the tap-receiving portion, and a safety device being disposed adjacent to the guiding recesses, so as to position the air tap and prevent the air tap from disassembling from the mounting member.

2. The safety structure for disassembling and positioning an airbag device as claimed in claim 1, wherein both ends of the positioning member are provided with a connecting portion, one of the connecting potions is pivotally connected to one end of a frame-shaped fastener via a pivot shaft, a combining strip is extended from the other connecting portion, at a waist portion of the fastener is provided a separating rod to divide the fastener into two hollow guiding portions, and both sides of the fastener are provided with a round protrusion, respectively.

3. The safety structure for disassembling and positioning an airbag device as claimed in claim 1, wherein both ends of the positioning member are formed with a containing portion, respectively, and around an inner periphery of each containing portion is formed a receiving portion.

4. The safety structure for disassembling and positioning an airbag device as claimed in claim 1, wherein the engaging member is disposed on the positioning member and is a vertical and laminar element, the engaging member is located corresponding to the other end of the actuating device, the actuating device is provided with an elastic portion to be engaged with the engaging member, the positioning member is formed with two vertical pin-insertion portions located corresponding to both ends of the engaging member, each pin-insertion portion is defined with a through hole, in a center between the pin-insertion portions is provided an adjusting seat having a threaded hole;

a vertical side of the engaging member is located outside the pin-insertion portions of the positioning member and is formed with a concave engaging portion, both ends of the vertical side of the engaging member are defined with a threaded portion in the form of a threaded hole, at least one positioning bolt is screwed through the pin-insertion portions into the threaded portions, a forcing bolt passes through a center of a horizontal side of the engaging member, a threaded end of the forcing bolt is screwed in the adjusting seat, and a large diameter head portion of the forcing bolt pushes against the engaging member.

5. The safety structure for disassembling and positioning an airbag device as claimed in claim 1, wherein the actuating device is a hollow cover which cooperates with the air bottle and the positioning member, the air bottle is inserted into the mounting member disposed in the actuating device, the mounting member is defined with a combining portion in the form of an opening and a guiding portion connected to the combining portion, a tap-receiving portion having an inner guiding structure is defined in the mounting member and is vertical and connected to the guiding portion of the mounting member;

the actuator is movably received in the guiding portion of the mounting member;

the actuating device is defined with a through hole for insertion of the safety device;

the actuator comprises an actuating member and a guide shaft, one end of the actuating member is connected to the positioning member, a pivotal position of the actuating member with respect to the positioning member is different from that of the actuating device, the other end of the actuating member is pivotally connected to one end of the guide shaft, the other end of the guide shaft is inserted into the guiding portion of the mounting member, the guide shaft is provided with a plurality of sets of airtight portions in the form of an airtight ring, the other end of the guide shaft is formed with a firing pin;

the tap-receiving portion is disposed in a center of the guiding portion of the mounting member located toward the airbag device, a penetrating locking hole with a circular cross section is defined in the guiding slot and located adjacent to each guiding recess, and the safety device is disposed opposite the locking holes.

6. The safety structure for disassembling and positioning an airbag device as claimed in claim 5, wherein the guiding blocks of the air tap are shaped and sized to fit the guiding recesses of the tap-receiving portion, and the guiding recesses or the guiding blocks are designed to be different from one another in width.

7. The safety structure for disassembling and positioning an airbag device as claimed in claim 1, wherein threads are defined in an inner surface of the air tap of the airbag device, a through hole is defined in a bottom of the air tap, around a periphery of the through hole of the air tap is defined a plurality of air holes, the check device comprises a main member, one end of the main member is a large diameter disk and is mounted with a stopping member, the other end of the main member is a shaft which has inner threads and passes through the through hole of the air tap, an end of the shaft is screwed with a fixing member in the form of a nut, and an elastic member in the form of a spring is mounted on the main member and biased between the fixing member and the through hole of the air tap.

8. The safety structure for disassembling and positioning an airbag device as claimed in claim 1, wherein the mounting member is formed with an adjusting portion, an adjusting member is disposed in the adjusting portion, one end of the adjusting member protruded out of the adjusting portion is provided with an adjusting end having a driven portion, in a middle portion of the adjusting member is defined a penetrating portion for insertion of the firing pin, and the other end of the adjusting member is provided with a tapered regulating portion opposite the tap-receiving portion.

9. The safety structure for disassembling and positioning an airbag device as claimed in claim 1, wherein the safety device is provided with a safety bolt, a pushing portion is vertically extended from the safety bolt and passes through a through hole and a penetrating hole of the actuating device, a column-shaped locking portion is extended from one horizontal end of the safety bolt, the other horizontal end of the safety bolt is provided with an elastic element in the form of a spring for prevention of reverse movement of the guiding blocks, the safety bolt and the elastic element are simultaneously put into a reverse T-shaped seat, the seat is defined with a receiving groove corresponding to the safety bolt, and both extended sides of the seat are provided for insertion of bolts, so as to position the safety device in the actuating device.

10. The safety structure for disassembling and positioning an airbag device as claimed in claim 1, wherein the actuating device is disposed with a retaining device located adjacent to the mounting member, the retaining device comprises an airtight stopper and a vent rod, the airtight stopper is in the form of a nut and is defined with outer threads to be screwed with inner threads of the air tap, so as to seal the air tap to prevent air from leaking therefrom, one end of the vent rod is a small diameter top portion, and the other end of the vent rod is defined with outer threads to be screwed with the inner threads of the air tap for enabling the top portion to abut against a fixing member of a main member, the vent rod is defined with a penetrating vent hole for deflating the airbag device and is defined with a notch, the top portion of the vent rod is defined with inner threads to be screwed with the outer threads of the airtight stopper, and a laminar blocking member cooperates with a fixing bolt to lock the airtight stopper and the vent rod in a space of the actuating device, so as to abut against the airtight stopper and the vent rod.

11. A safety structure for disassembling and positioning an airbag device, comprising: an actuating device disposed with a mounting member for mounting an air bottle and an airbag device;

the mounting member being defined with a guiding portion located corresponding to the air bottle, a tap-receiving portion being disposed in the guiding portion of the mounting member and located toward the airbag device, in the tap-receiving portion being defined at least one set of guiding recesses, an air tap of the airbag device being provided with at least one set of guiding blocks aligned with the guiding recesses of the tap-receiving portion, each guiding recess extending to connect a guiding slot part of which penetrates a peripheral surface of the tap-receiving portion, a penetrating locking hole with a circular cross section being defined in the guiding slot and located adjacent to each guiding recess, and a safety device being disposed opposite the locking holes.

12. The safety structure for disassembling and positioning an airbag device as claimed in claim 11, wherein the safety device is provided with a safety bolt, a pushing portion is extended from the safety bolt and passes through the actuating device, a locking portion is extended from one end of the safety bolt, the other end of the safety bolt is provided with an elastic element, the safety bolt and the elastic element are simultaneously put into a seat, the seat is defined with a receiving groove corresponding to the safety bolt, and both extended sides of the seat are provided for insertion of bolts, so as to position the safety device in the actuating device.

13. A safety structure for disassembling and positioning an airbag device, comprising: an actuating device disposed with a mounting member for mounting an air bottle and an airbag device, the actuating device being pivotally connected to a positioning member, an actuator being disposed between the actuating device and the positioning member and located corresponding to the air bottle, the actuator being provided with a firing pin located corresponding to the air bottle, the air bottle being defined with a sealing member;

the positioning member being provided with a vertical and laminar engaging member located corresponding to the actuating device, the actuating device being provided with an elastic portion to be engaged with the engaging member, the positioning member being formed with two pin-insertion portions located corresponding to the engaging member, each pin-insertion portion being defined with a through hole, an adjusting seat having a threaded hole being disposed adjacent to the pin-insertion portions;

a vertical side of the engaging member being located outside the pin-insertion portions of the positioning member and formed with an engaging portion, both ends of the vertical side of the engaging member being defined with a threaded portion, at least one positioning bolt being screwed through the pin-insertion portions into the threaded portions, a forcing bolt passing through a center of a horizontal side of the engaging member, the forcing bolt being screwed in the adjusting seat, and a head portion of the forcing bolt pushing against the engaging member.

14. A safety structure for disassembling and positioning an airbag device, comprising: an actuating device disposed with a mounting member for mounting an air bottle and an airbag device;

a retaining device having an airtight stopper and a vent rod, the airtight stopper being in the form of a nut and defined with threads to be screwed with threads of an air tap, so as to seal the air tap, one end of the vent rod being a small diameter top portion, the other end of the vent rod being defined with threads to be screwed with the threads of the air tap for enabling the top portion to abut against a fixing member of a main member, the vent rod being defined with a penetrating vent hole and a notch, the top portion of the vent rod being defined with threads to be screwed with the threads of the airtight stopper, and a laminar blocking member cooperating with a fixing bolt to lock the airtight stopper and the vent rod in a space of the actuating device, so as to abut against the airtight stopper and the vent rod.

* * * * *